US010276079B2

(12) United States Patent
Lim et al.

(10) Patent No.: US 10,276,079 B2
(45) Date of Patent: Apr. 30, 2019

(54) DISPLAY PANEL

(71) Applicant: SAMSUNG DISPLAY CO., LTD., Yongin-si, Gyeonggi-do (KR)

(72) Inventors: Namjae Lim, Gwacheon-si (KR); Sungjae Park, Wonju-si (KR); Jung-won Kim, Seoul (KR); Jinpil Kim, Suwon-si (KR); Jaesung Bae, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 206 days.

(21) Appl. No.: 15/170,857

(22) Filed: Jun. 1, 2016

(65) Prior Publication Data

US 2017/0069244 A1 Mar. 9, 2017

(30) Foreign Application Priority Data

Sep. 9, 2015 (KR) ..... 10-2015-0127858

(51) Int. Cl.

*G09G 3/20* (2006.01)
*G09G 3/36* (2006.01)
*G09G 5/06* (2006.01)

(52) U.S. Cl.

CPC ..... *G09G 3/2003* (2013.01); *G09G 3/3607* (2013.01); *G09G 5/06* (2013.01); *G09G 2300/0443* (2013.01); *G09G 2300/0452* (2013.01); *G09G 2320/0666* (2013.01); *G09G 2320/0673* (2013.01); *G09G 2340/06* (2013.01)

(58) Field of Classification Search

CPC ..... G09G 2300/0452; G09G 3/2003; G09G 3/3607; G09G 3/2074; G09G 2300/0443; H01L 27/3213; H01L 27/3218; H01L 27/3216

See application file for complete search history.

(56) References Cited

U.S. PATENT DOCUMENTS

2008/0122874 A1* 5/2008 Han ..... G09G 3/2003 345/690
2009/0079676 A1* 3/2009 Shirasaki ..... G02F 1/167 345/76
2011/0181627 A1* 7/2011 You ..... G09G 3/3406 345/690
2013/0135572 A1* 5/2013 Park ..... G02F 1/134336 349/143
2013/0181985 A1* 7/2013 Katsuta ..... G09G 3/3648 345/419
2014/0204321 A1* 7/2014 Koh ..... G02F 1/133514 349/109

(Continued)

FOREIGN PATENT DOCUMENTS

KR 10-2012-0026878 A 3/2012
KR 10-2013-0026903 A 3/2013
KR 10-2015-0020844 A 2/2015

*Primary Examiner* — Gerald Johnson

(74) *Attorney, Agent, or Firm* — Lewis Roca Rothgerber Christie LLP

(57) ABSTRACT

A display device including a pixel including a mixed sub pixel configured to receive a mixed data voltage, the mixed sub pixel including a lower pixel configured to display white light having a white color corresponding to the mixed data voltage, and an upper pixel configured to display an auxiliary color light having an auxiliary color corresponding to the mixed data voltage.

19 Claims, 9 Drawing Sheets

(56) References Cited

U.S. PATENT DOCUMENTS

| | | | | |
|---|---|---|---|---|
| 2015/0042939 | A1* | 2/2015 | Park | G02F 1/134336 349/144 |
| 2016/0253940 | A1* | 9/2016 | Wang | G09G 3/20 345/694 |
| 2016/0315127 | A1* | 10/2016 | Yoon | H01L 27/3218 |

* cited by examiner

DISPLAY PANEL

CROSS-REFERENCE TO RELATED APPLICATION

This U.S. non-provisional patent application claims priority to, and the benefit of, Korean Patent Application No. 10-2015-0127858, filed on Sep. 9, 2015, the entire contents of which are hereby incorporated by reference.

BACKGROUND

1. Field

Embodiments of the present disclosure relate to a display device having improved brightness and color reproducibility.

2. Description of the Related Art

A general display device expresses colors by using combinations of the three primary colors of red, green, and blue. Accordingly, a pixel provided in a general display device includes red, green, and blue sub pixels for displaying red, green, and blue colors, respectively.

Recently, a display device for displaying colors by using red, green, blue, and other assorted colors is under development. The assorted colors may be one of magenta, cyan, yellow, and white, or may be two or more colors. Additionally, to improve the brightness of a displayed image, a display device including red, green, blue, and white sub pixels is under development. Such a display device receives red, green, and blue light signals, and converts them into red, green, blue, and white data signals. The converted red, green, blue, and white data signals are respectively provided to corresponding red, green, blue, and white sub pixels. As a result, an image is displayed by the corresponding red, green, blue, and white sub pixels.

SUMMARY

The present disclosure provides a display device having improved brightness and color reproducibility.

An embodiment of the inventive concept provides a display device including a pixel including a mixed sub pixel configured to receive a mixed data voltage, the mixed sub pixel including a lower pixel configured to display white light having a white color corresponding to the mixed data voltage, and an upper pixel configured to display an auxiliary color light having an auxiliary color corresponding to the mixed data voltage.

An intensity of the white light may be less than an intensity of the auxiliary color light according to a mixed grayscale of the mixed data voltage.

The lower pixel may correspond to a first gamma curve with respect to the mixed grayscale of the mixed data voltage, the upper pixel may correspond to a second gamma curve with respect to the mixed grayscale of the mixed data voltage, and the second gamma curve may correspond to a greater intensity than the first gamma curve.

A gamma value of the first gamma curve may be greater than about 2.2, and a gamma value of the second gamma curve may be less than about 2.2.

The lower pixel may be turned off in a low grayscale section, and may be turned on in a high grayscale section, and the mixed grayscale of the mixed data voltage may be less than a reference grayscale in the low grayscale section, and may be greater than the reference grayscale in the high grayscale section.

The upper pixel may be turned on in the low grayscale section.

An intensity of the white light may be less than an off perception intensity in the low grayscale section, which might not perceivably different from an off intensity corresponding to a grayscale value of 0.

The display device may further include a control unit configured to generate mixed output data corresponding to input image information, and a mapping unit configured to perform a first mapping on the input image information with a first gamut including white when there is a white component in the input image information, and perform a second mapping on the input image information with a second gamut including the auxiliary color when there is an auxiliary color component in the input image information and there is no white component in the input image information, and a data driver configured to convert the mixed output data into the mixed data voltage.

The mapping unit may be further configured to generate white mapping data corresponding to the white component corresponding to the input image information through the first mapping, output the white mapping data as mixed mapping data, generate auxiliary color mapping data corresponding to the auxiliary color component corresponding to the input image information through the second mapping, and output the auxiliary color mapping data as the mixed mapping data.

The control unit may include a color correction unit that, when the mapping unit performs the first mapping, is configured to perform a first comparison of the reference grayscale to a grayscale value of the white mapping data, correct the white mapping data with a first gamma correction value or a second gamma correction value according to the first comparison, and output a first correction result as the mixed output data.

The mapping unit may be further configured to generate red mapping data, green mapping data, and blue mapping data corresponding to the input image information, and the color correction unit may be further configured to correct the red mapping data, the green mapping data, and the blue mapping data with the first or second gamma correction value according to the first comparison when the mapping unit performs the first mapping.

When the mapping unit performs the second mapping, the color correction unit may be further configured to perform a second comparison on the reference grayscale and a grayscale value of the auxiliary color mapping data, correct the auxiliary color mapping data with a third gamma correction value or a fourth gamma correction value according to the second comparison, and output a second correction result as the mixed output data.

The mapping unit may be further configured to generate red mapping data, green mapping data, and blue mapping data corresponding to the input image information, and the color correction unit may be further configured to correct the red mapping data, the green mapping data, and the blue mapping data with the third or fourth gamma correction value according to the second comparison when the mapping unit performs the second mapping.

A maximum value of a grayscale of the mixed output data may include the reference grayscale.

The display device may further include a data line configured to output the mixed data voltage, the upper pixel may include an upper pixel circuit configured to provide the mixed data voltage to an upper pixel electrode of the upper pixel, and the lower pixel may include a lower pixel circuit configured to lower a level of the mixed data voltage to covert the mixed data voltage into a low data voltage, and provide the low data voltage to a lower pixel electrode of the lower pixel.

The upper pixel circuit may include an upper transistor including a source electrode coupled to the data line, a gate electrode coupled to a gate line of the display device, and a drain electrode coupled to the upper pixel electrode.

The lower pixel circuit may include a first lower transistor including a source electrode connected to the data line, a gate electrode connected to a gate line of the display device, and a drain electrode connected to the lower pixel electrode, and a second lower transistor including a source electrode configured to receive a lowered voltage, a gate electrode connected to the gate line, and a drain electrode connected to the lower pixel electrode.

The pixel may further include a red sub pixel, a green sub pixel, and a blue sub pixel, which are configured to respectively display red, green, and blue.

The auxiliary color may be a secondary primary color.

Another embodiment of the inventive concept provides a display panel including a mixed data line, and a mixed sub pixel including an upper pixel connected to the mixed data line and including a first color filter configured to transmit an auxiliary color, and a lower pixel connected the mixed data line and not including a color filter.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
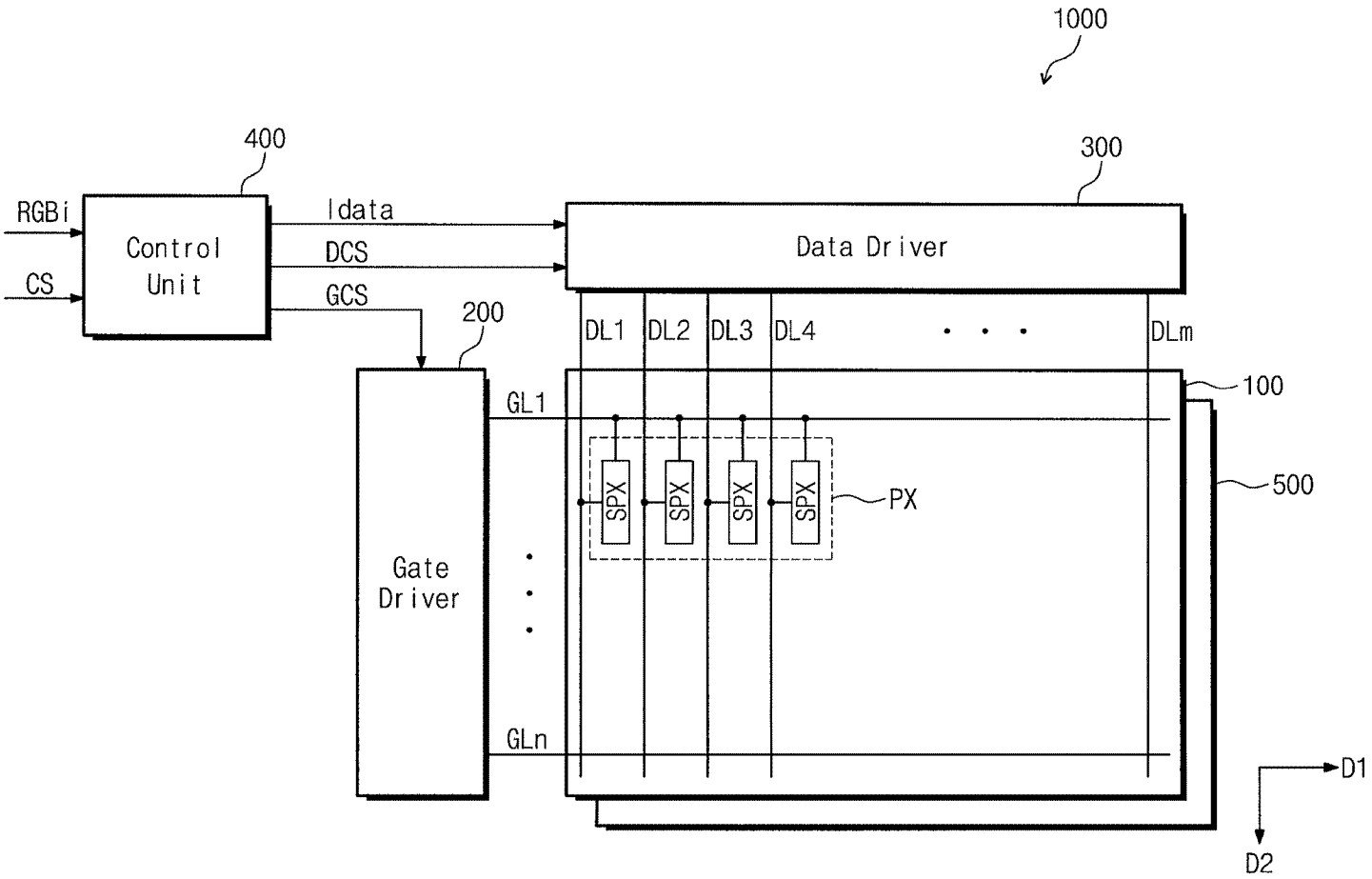
FIG. 1 is a block diagram illustrating a display device according to an embodiment of the inventive concept.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to an embodiment of the inventive concept.

Referring to FIG. 1, the display device 1000 includes a display panel 100 for displaying an image, a gate driver 200 and a data driver 300 for driving the display panel 100, and a control unit 400 for controlling the driving of the gate driver 200 and the data driver 300.

The control unit 400 receives input image information RGBi and a plurality of control signals CS, which are externally supplied from the outside of the display device 1000. The control unit 400 processes data format or information of the input image information RGBi to correspond to the interface of the data driver 300, and to correspond to the specification of the display panel 100, to generate output image data Idata, and to provide the output image data Idata to the data driver 300.

Additionally, the control unit 400 generates a data control signal DCS (for example, an output start signal, a parallel start signal, and so on) and a gate control signal GCS (for example, a vertical start signal, a vertical clock signal, and a vertical clock bar signal) on the basis of (e.g., corresponding to) the plurality of controls signals CS. The data control signal DCS is provided to the data driver 300, and the gate control signal GCS is provided to the gate driver 200.

The gate driver 200 outputs gate signals sequentially in response to the gate control signal GCS provided from the control unit 400.

The data driver 300 converts the output image data Idata into data voltages, and outputs the data voltages to the display panel 100, in response to the data control signal DCS provided from the control unit 400.

The display panel 100 includes a plurality of gate lines GL1 to GLn, a plurality of data lines DL1 to DLm, and a plurality of pixels PX. Only one pixel PX is shown in FIG. 1, while all other pixels are omitted.

Each of the plurality of pixels PX is a device for displaying a unit image for collectively configuring an image. The plurality of pixels PX are arranged in a matrix along first and second directions D1 and D2. The resolution of the display panel 100 may be determined according to the number of the pixels PX provided in the display panel 100. Each of the pixels PX may include a plurality of sub pixels SPX.

The plurality of sub pixels SPX are arranged in a matrix along the first and second directions D1 and D2. Each of the sub pixels SPX may display one of primary colors, such as red, green, and blue. Additionally, as will be described later, a color displayed by the plurality of sub pixels SPX is not limited to red, green, and blue, and the plurality of sub pixels SPX may display various colors, for example, secondary primary colors, such as white, yellow, cyan, and magenta, in addition to the red, green, and blue colors.

According to the present embodiment of the inventive concept, each of the plurality of pixels PX may include four sub pixels SPX. However, the inventive concept is not limited thereto, and the pixel PX may include two, three, or five or more sub pixels SPX.

The plurality of gate lines GL1 to GLn extend in the first direction D1, and are arranged parallel to each other in the second direction (e.g., a vertical direction) D2, which is perpendicular to the first direction D1. The plurality of gate lines GL1 to GLn are connected to the gate driver 200, and sequentially receive the gate signals from the gate driver 200.

The plurality of data lines DL1 to DLm extend in the second direction D2, and are arranged parallel to each other in the first direction D1. The plurality of data lines DL1 to DLm are connected to the data driver 300 to receive the data voltages from the data driver 300.

The control unit 400 may be mounted in the form of an integrated circuit chip on a printed circuit board, and may be connected to the gate driver 200 and the data driver 300. The gate driver 200 and the data driver 300 may be formed of a plurality of driving chips, may be mounted on a flexible printed circuit board, and may be connected to the display panel 100 in a Tape Carrier Package (TCP) method. However, the inventive concept is not limited thereto, and the gate driver 200 and the data driver 300 may instead be formed of a plurality of driving chips, and may be mounted on the display panel 100 in a Chip on Glass (COG) method. Additionally, the gate driver 200 and the transistors of the pixels PX may be formed at a same time (during a same process) and may be mounted on the display panel 100 in an Amorphous Silicon TFT Gate driver circuit (ASG) form.

The display panel DP is not particularly limited, and for example, may be various display panels, such as an organic light emitting display panel, a liquid crystal display panel, a plasma display panel, an electrophoretic display panel, and an electrowetting display panel. Hereinafter, an embodiment wherein the display panel 100 is a liquid crystal display panel is exemplarily described.

The display device 1000 further includes a backlight unit 500. The backlight unit 500 is at the rear of the display panel 100. The backlight unit 500 provides a backlight to the back surface of the display panel 100.

Figure 2:
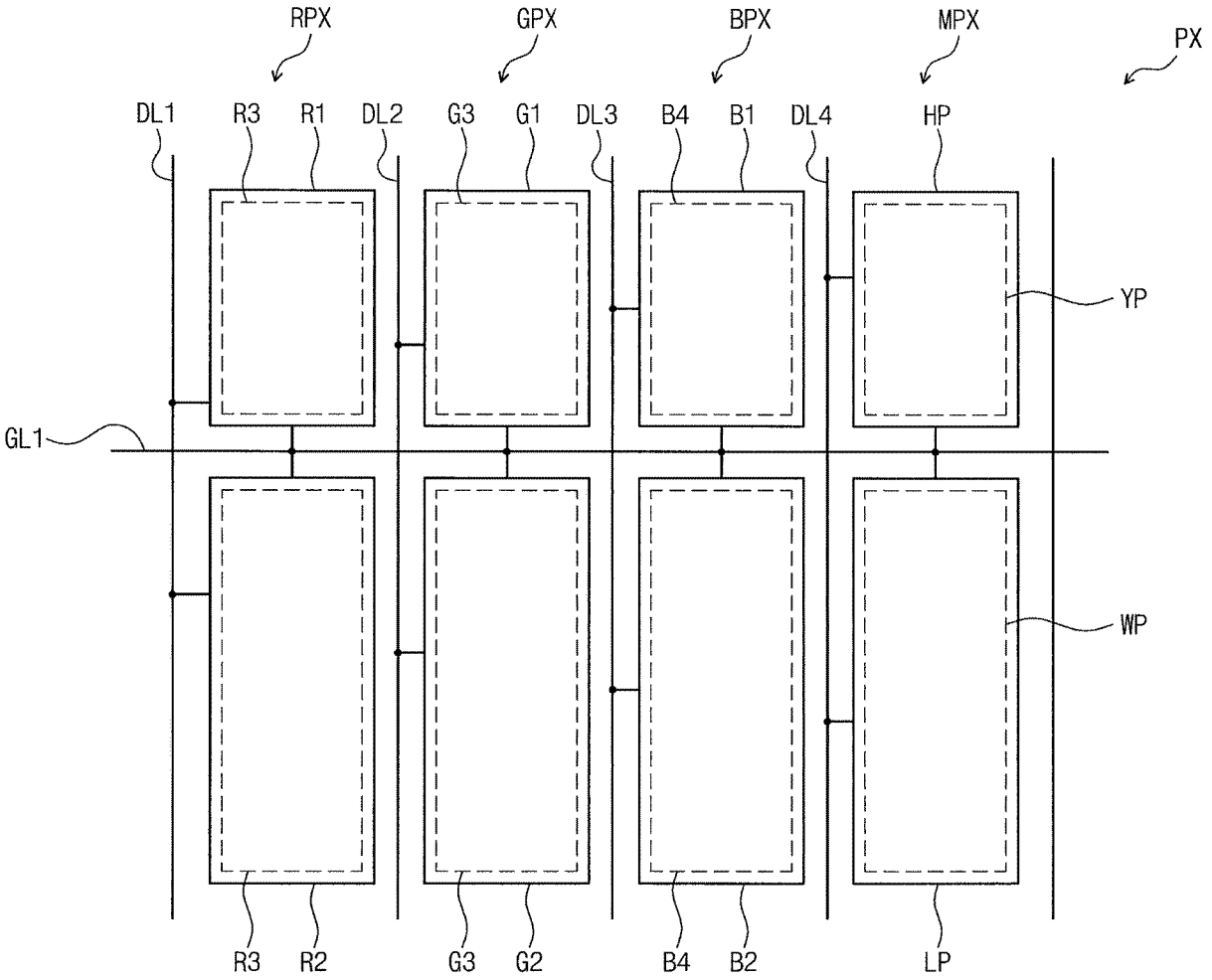
FIG. 2 is a schematic plan view of a pixel shown in FIG. 1.

FIG. 2 is a schematic plan view of a pixel shown in FIG. 1.

For convenience of description, FIG. 2 exemplarily illustrates one pixel PX, and illustrates only first to fourth data lines DL1 to DL4 and a first gate line GL1 connected to the one pixel PX.

According to an embodiment of the inventive concept, the pixel PX includes a red sub pixel RPX, a green sub pixel GPX, a blue sub pixel BPX, and a mixed sub pixel MPX. The red, green, and blue sub pixels RPX, GPX, and BPX display red light, green light, and blue light, respectively. The red, green, and blue lights have red, green, and blue colors, respectively. Additionally, the mixed sub pixel MPX displays white light and auxiliary color light. The white light has white color (e.g., a white shade of light), and the auxiliary color light has one color of magenta, cyan, or yellow.

In the present embodiment, the auxiliary color light is yellow light having yellow color, and is described exemplarily, noting that the auxiliary color light may be other auxiliary colors.

The red sub pixel RPX includes a red upper pixel R1 and a red lower pixel R2. The red upper pixel R1 and the red lower pixel R2 include a red color filter(s) R3 that transmits red color. The red upper pixel R1 and the red lower pixel R2 are electrically connected to the first data line DL1, and receive a first data voltage from the first data line DL1.

The red upper pixel R1 displays high red light having a high grayscale corresponding to the first data voltage. The red lower pixel R2 lowers a level of the first data voltage, and displays low red light having a low grayscale corresponding to the lowered first data voltage. The red lower pixel R2 may include a circuit for lowering a level of the first data voltage.

Because the high grayscale and the low grayscale are different, a tilted angle of liquid crystal molecules of the red upper pixel R1 when the high red light is displayed, and a tilted angle of liquid crystal molecules of the red lower pixel R2 when the low red light is displayed, are different. As a result, a viewing angle of the red sub pixel RPX may be improved.

The green sub pixel GPX includes a green upper pixel G1 and a green lower pixel G2. The green upper pixel G1 and the green lower pixel G2 include a green color filter(s) G3 that transmits green color. The green upper pixel G1 and the green lower pixel G2 are electrically connected to the second data line DL2, and receive a second data voltage from the second data line DL2.

The green upper pixel G1 displays high green light having a high grayscale corresponding to the second data voltage. The green lower pixel G2 lowers a level of the second data voltage, and displays low green light having a low grayscale corresponding to the lowered second data voltage. The green lower pixel G2 may include a circuit for lowering a level of the second data voltage.

The blue sub pixel BPX includes a blue upper pixel B1 and a blue lower pixel B2. The blue upper pixel B1 and the blue lower pixel B2 include a blue color filter(s) B3 that transmits blue color. The blue upper pixel B1 and the blue lower pixel B2 are electrically connected to the third data line DL3, and receive a third data voltage from the third data line DL3.

The blue upper pixel B1 displays high blue light having a high grayscale corresponding to the third data voltage. The blue lower pixel B2 lowers a level of the third data voltage, and displays low blue light having a low grayscale corresponding to the lowered third data voltage. The blue lower pixel B2 may include a circuit for lowering a level of the third data voltage.

The mixed sub pixel MPX includes an upper pixel HP and a lower pixel LP. The upper pixel HP and the lower pixel LP may display the yellow light and the white light, respectively.

According to an embodiment of the inventive concept, the upper pixel HP includes a yellow color filter YP that transmits yellow color. According to another embodiment of the inventive concept, the upper pixel HP may include a color filter that transmits another secondary primary color, such as magenta or cyan. The secondary primary color may be defined as a color obtained by mixing one or more of red, green, and blue (that is, by mixing primary colors).

The lower pixel LP does not include a color filter, and includes a transmission part WP. When white light having a white color is incident to the transmission part WP, white light having substantially the same color coordinates as the incident white light may be transmitted.

The upper pixel HP and the lower pixel LP of the mixed sub pixel MPX are electrically connected to the fourth data line DL4, and receive a fourth data voltage from the fourth data line DL4. Hereinafter, for convenience of description, the fourth data voltage may be referred to as a mixed data voltage. Additionally, the fourth data line DL4 may be referred to as a mixed data line.

The upper pixel HP in the present embodiment displays yellow light having a high grayscale corresponding to the mixed data voltage. The lower pixel LP lowers a level of the mixed data voltage, and converts the mixed data voltage into a low data voltage. The lower pixel LP displays white light having a low grayscale corresponding to the low data voltage. The lower pixel LP may include a circuit for lowering a level of the mixed voltage.

In such a way, because the mixed sub pixel MPX includes the lower pixel LP for displaying white light, the display panel 100 of FIG. 1 may improve the brightness.

Additionally, because the mixed sub pixel MPX includes the upper pixel HP for displaying yellow light, the display panel 100 of FIG. 1 may improve the color reproducibility. In more detail, when the display panel 100 includes a pixel for displaying white light such as the lower pixel LP, a simultaneous contrast issue that color perception for yellow light is deteriorated occurs. That is, as the maximum grayscale of yellow light adjacent white light is relatively lowered in comparison to the maximum grayscale of white light, the color sense of yellow light perceived by a user may be decreased. However, according to the inventive concept, as the upper pixel HP is included, the percentage of yellow light may be improved. As a result, contrast may be improved.

Hereinafter, a circuit of the mixed sub pixel MPX is described. Because circuits of the red, green, and blue sub pixels RPX, GPX, and BPX are similar to that of the mixed sub pixel MPX, the mixed sub pixel MPX is mainly described, and descriptions for the red, green, and blue sub pixels RPX, GPX, and BPX are omitted.

Figure 3:
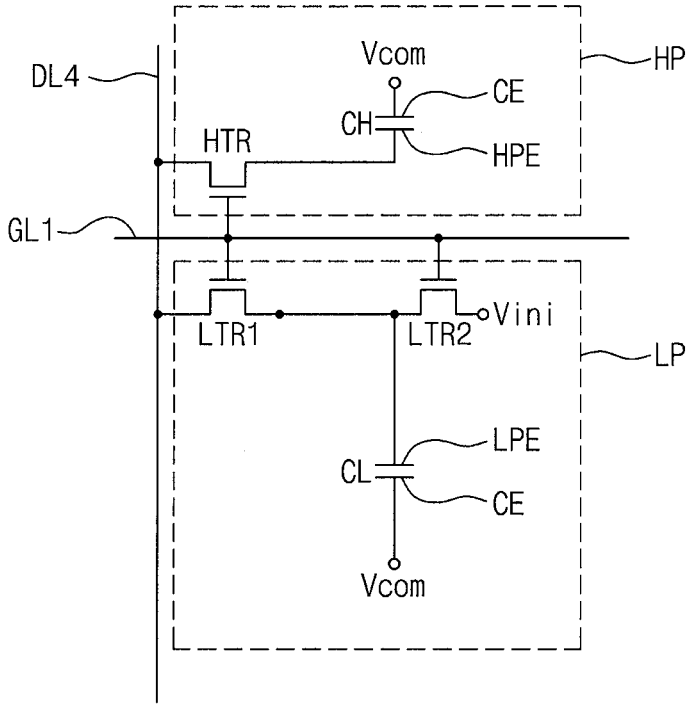
FIG. 3 is a circuit diagram of a mixed sub pixel shown in FIG. 2.

FIG. 3 is a circuit diagram of a mixed sub pixel MPX shown in FIG. 2.

Referring to FIG. 3, the lower pixel LP and the upper pixel HP are disposed with the first gate line GL1 therebetween.

The upper pixel HP includes an upper pixel circuit. The upper pixel circuit may control yellow light displayed by the upper pixel HP in response to a gate signal and in response to the mixed data voltage. The upper pixel circuit includes an upper transistor HTR, an upper pixel electrode HPE, and an upper liquid crystal capacitor CH.

The lower pixel LP includes a lower pixel circuit. The lower pixel circuit may control a white color image displayed by the lower pixel LP in response to a gate signal and in response to the mixed data voltage. Additionally, the lower pixel circuit, as mentioned above, may lower the mixed data voltage. The lower pixel circuit includes the first and second lower transistors LTR1 and LTR2, a lower pixel electrode LPE, and a lower liquid crystal capacitor CL.

The first electrode of the lower liquid crystal capacitor CL may be the lower pixel electrode LPE, and the second electrode of the lower liquid crystal capacitor CL may be a common electrode CE. The first electrode of the upper liquid crystal capacitor CH may be the upper pixel electrode HPE, and the second electrode of the upper liquid crystal capacitor CH may be the common electrode CE.

The upper transistor HTR may include a gate electrode connected to the first gate line GL1, a source electrode connected to the fourth data line DL4, and a drain electrode connected to the upper pixel electrode HPE.

The upper transistor HTR receives a gate signal from the first gate line GL1. When the upper transistor HTR is turned on in response to a gate signal, the mixed data voltage may be provided to the upper pixel electrode HPE.

The first and second lower transistors LTR1 and LTR2 provide a low data voltage, which has a different level than the mixed data voltage, to the lower pixel electrode LPE. Herein, the low data voltage may be determined based on the mixed data voltage.

The first lower transistor LTR1 may include a gate electrode connected to the first gate line GL1, a source electrode connected to the fourth data line DL4, and a drain electrode connected to the lower pixel electrode LPE.

The second lower transistor LTR2 may include a gate electrode connected to the first gate line GL1, a drain connected to the lower pixel electrode LPE, and a source electrode for receiving a storage voltage Vini. A voltage (hereinafter, referred to as a lowered voltage) received by the drain of the second lower transistor LTR2 is not limited to the storage voltage Vini. The lowered voltage may be a different voltage that is lower than a voltage corresponding to a grayscale corresponding to the mixed data voltage.

The size of the upper transistor HTR and the size of the first lower transistor LTR1 may substantially identical. The size of the second lower transistor LTR2 may be lower than the size of the first lower transistor LTR1.

The first and second lower transistors LTR1 and LTR2 are turned on in response to a gate signal provided through the first gate line GL1. The turned-on first lower transistor LTR1 provides the mixed data voltage received through the fourth data line DL4 to the lower pixel electrode LPE. The turned-on second lower transistor LTR2 provides the storage voltage Vini to the lower pixel electrode LPE, and lowers a level of the mixed data voltage to generate a low data voltage.

In more detail, the low data voltage is a voltage that is divided by a resistance value in resistance state when the first lower transistor LTR1 and the second lower transistor LTR2 are turned on. A level of the low data voltage has an intermediate level between the mixed data voltage and the storage voltage Vini.

According to the above, the first and second lower transistors LTR1 and LTR2 and the upper transistor HTR are turned on in response to a gate signal. In this case, the mixed data voltage may be provided toward the upper pixel electrode HPE through the upper transistor HTR, and the low data voltage may be provided toward the lower pixel electrode LPE through the first and second lower transistors LTR1 and LTR2.

As a result, when the mixed data voltage is applied to the mixed sub pixel MPX, data voltages having different levels may be applied to the lower pixel electrode LPE and to the upper pixel electrode HPE, and the lower pixel LP and the upper pixel HP may respectively display white light and yellow light having different grayscales.

Because the lower pixel LP and the upper pixel HP are driven by one data line when displaying images having different colors, the number of data lines of the display panel 100 of FIG. 2 may be reduced. If the number of data lines is reduced, because the number of channels of the data drivers 300 for driving the data lines is reduced, power consumption by the data driver 300 may be reduced. Additionally, if the number of data lines is reduced, because a black matrix area of the display panel 100 occupied by the data lines becomes smaller, the aperture ratio of a pixel may be increased, and the resolution of the display panel 100 may be improved.

Although the lower pixel circuit includes two transistors, according to an embodiment of the inventive concept, the lower pixel circuit may include three or more transistors, and may include other electronic devices, according to another embodiment of the inventive concept. It is sufficient that the lower pixel circuit is connected to the fourth data line and changes a level of the mixed data voltage.

Figure 4:
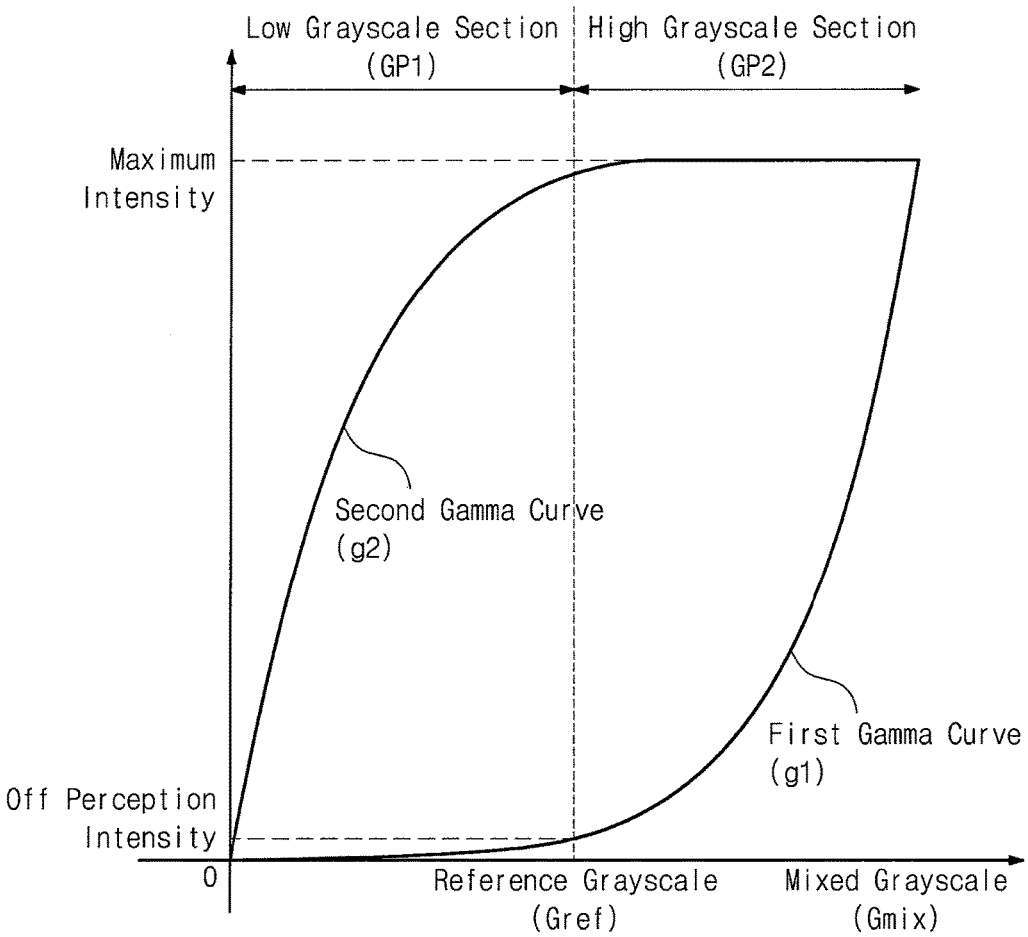
FIG. 4 illustrates gamma curves of a lower pixel and an upper pixel shown in FIG. 3.

FIG. 4 illustrates gamma curves of a lower pixel and an upper pixel shown in FIG. 3.

Referring to FIGS. 3 and 4, the x-axis of FIG. 4 represents a grayscale (hereinafter referred to as a mixed grayscale) Gmix of the mixed data voltage, and the y-axis represents the intensity of light. A first gamma curve g1 is a gamma curve of the lower pixel LP for the mixed data voltage. The first gamma curve g1 represents the intensity of the white light according to the mixed grayscale Gmix. A second gamma curve g2 is a gamma curve of the upper pixel HP for the mixed data voltage. The second gamma curve g2 represents the intensity of the yellow light according to the mixed grayscale Gmix.

The values (that is, the intensity of light) of the first and second gamma curves g1 and g2 are normalized. Accordingly, the values of the first and second gamma curves g1 and g2 may have values from the off intensity to the maximum intensity. Herein, the off intensity may have a grayscale value of 0 corresponding to black, and the maximum intensity may have a value of 1.

Because the upper pixel electrode HPE receives the mixed data voltage, and because the lower pixel electrode LPE receives the low data voltage, the first and second gamma curves g1 and g2 are different. In more detail, the first and second gamma curves g1 and g2 may have different values (for example, different values of the y-axis, i.e., the intensity of an image) with respect to the mixed grayscale Gmix of the mixed data voltage. According to an embodiment of the inventive concept, a value of the first gamma curve g1 is smaller than a value of the second gamma curve g2 with respect to the same mixed grayscale Gmix. According to an embodiment of the inventive concept, a gamma value of the first gamma curve g1 is greater than about 2.2, and a gamma value of the second gamma curve g2 may be smaller than about 2.2.

The lower pixel LP may be on or off on the basis of (e.g., corresponding to) a reference grayscale Gref. In more detail, the lower pixel LP may be off, or perceived as off, in a low grayscale section GP1, and may be on in a high grayscale section GP2. The reference grayscale Gref, for example, may be a 125 grayscale.

The reference grayscale Gref is the boundary between the low grayscale section GP1 and the high grayscale section GP2. The mixed grayscale Gmix in the low grayscale section GP1 may be smaller than the reference grayscale Gref, and the mixed grayscale Gmix in the high grayscale section GP2 may be greater than the reference grayscale Gref.

The intensity of the white light in the low grayscale section GP1, that is, a value of the first gamma curve g1, is smaller than an off perception intensity. The off perception intensity may be determined by experiments. When a grayscale of white light is less than the off perception intensity, it is difficult for a user to perceive the white light. That is, the off perception intensity is a level of intensity of light at which a user may not distinguish from an off intensity having a grayscale value of 0.

The upper pixel HP may be on in the low grayscale section GP1 and the high grayscale section GP2. The intensity of the yellow light in the low grayscale section GP1, that is, a value of the second gamma curve g2, may be saturated substantially. That is, the intensity of the yellow light in the reference grayscale Gref may be a value close to 1, which is the value of the maximum intensity.

A value of the second gamma curve g2 in the high grayscale section GP2 does not change (or barely changes), and a value of the first gamma curve g1 in the high grayscale section GP2 is increased drastically. For example, a slope of the first gamma curve g1 in the high grayscale section GP2 may be greater than a slope of the second gamma curve g2 in the high grayscale section GP2.

In such a way, as a value of the second gamma curve g2 is set to be large, and as a value of the first gamma curve g1 is set to be less than the off intensity in the low grayscale section GP1, color mixing between yellow light and white light may be prevented in the low grayscale section GP1.

Figure 5A:
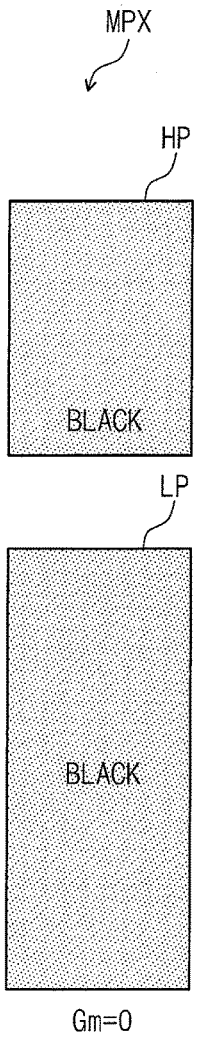
FIGS. 5A, 5B, and 5C are schematic plan views illustrating a display state according to a mixed grayscale of a mixed sub pixel.
Figure 5B:
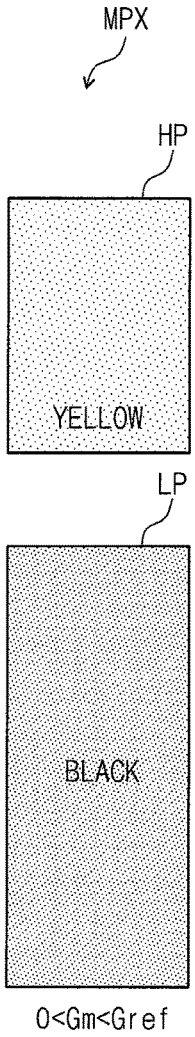
Figure 5C:
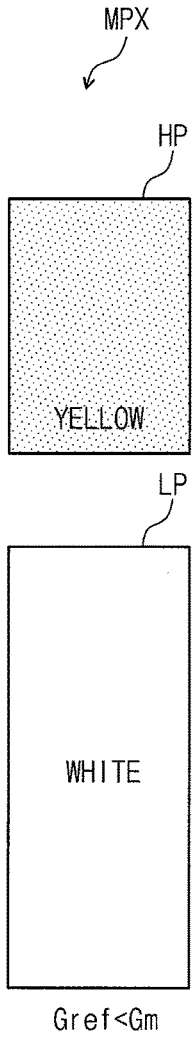

FIGS. 5A, 5B, and 5C are schematic plan views illustrating a display state according to a mixed grayscale of a mixed sub pixel.

FIG. 5A illustrates a display state of the mixed sub pixel MPX when the mixed grayscale Gmix is a grayscale value of 0. Such a state is referred to as a first state of the mixed sub pixel MPX. In the first state, the upper pixel HP and the lower pixel LP are all off. In more detail, because the mixed grayscale Gmix is 0 in the first state, the intensities of displayed images are 0 in the upper pixel HP and the lower pixel LP, and the upper pixel HP and the lower pixel LP display a black image.

FIG. 5B illustrates a display state of the mixed sub pixel MPX in the low grayscale section GP1 of FIG. 4 when the mixed grayscale Gmix satisfies $0<Gmix\leq$reference grayscale Gref. Such a state is referred to as a second state of the mixed sub pixel MPX. In the second state, the upper pixel HP is on and displays yellow light. The intensity of the yellow light may be the intensity of the second gamma curve g2 of FIG. 4 corresponding to a value of the mixed grayscale Gmix. On the other hand, the lower pixel LP is off in the second state. The intensity of the white light is less than the off perception intensity, and the lower pixel LP displays a black image.

FIG. 5C illustrates a display state of the mixed sub pixel MPX in the high grayscale section GP2 of FIG. 4 when the mixed grayscale Gmix satisfies reference grayscale $Gref<Gm$. Such a state is referred to as a third state of the mixed sub pixel MPX. In the third state, the upper pixel HP and the lower pixel LP are all on, and display yellow light and white light, respectively. The intensity of the yellow light may be the intensity of the second gamma curve g2 of FIG. 4 corresponding to a value of the mixed grayscale Gmix. The intensity of the white light may be the intensity of the second gamma curve g2 of FIG. 4 corresponding to a value of the mixed grayscale Gmix.

In such a way, as the mixed sub pixel MPX is driven in the first, second, and third states, the upper pixel HP and the lower pixel LP may be driven to display the yellow light and the white light through one data line. As a result, because the number of channels of the data driver 300 of FIG. 1 is reduced, power consumption may be reduced in the data driver 300. Additionally, if the number of data lines is reduced, because a black matrix area of the display panel 100 of FIG. 1 occupied by the data lines becomes smaller, the aperture ratio of a pixel may be increased, and the resolution of the display panel 100 may thereby be improved.

According to an embodiment of the present disclosure, image data that is the basis of the mixed data voltage is processed and generated based on the first, second, and third states. Hereinafter, such image data processing is described.

Figure 6:
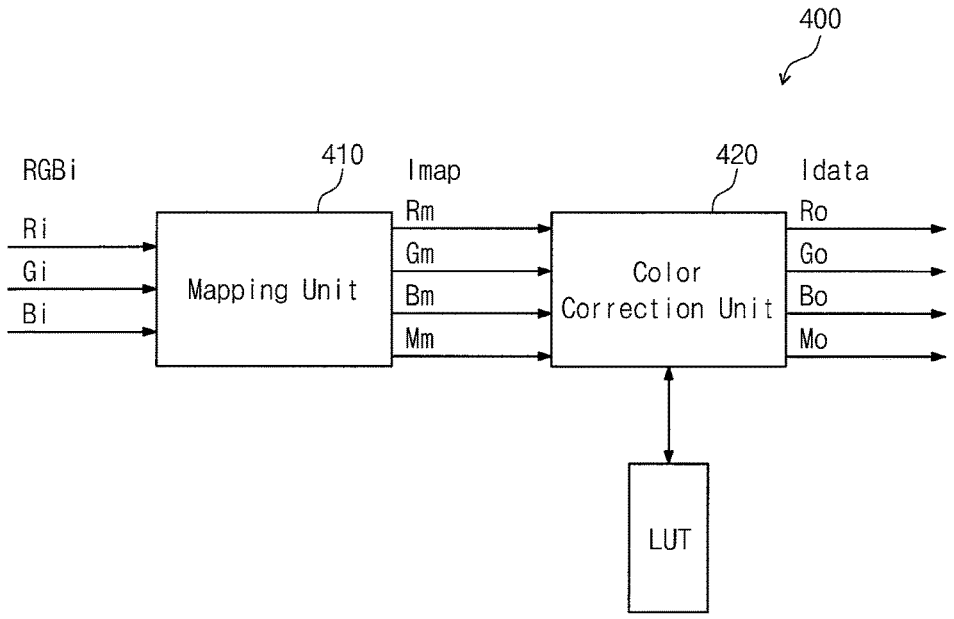
FIG. 6 is a schematic block diagram of a control unit shown in FIG. 1.

FIG. 6 is a schematic block diagram of a control unit shown in FIG. 1.

Referring to FIG. 6, as mentioned above, the control unit 400 receives the input image information RGBi, and generates output image data on the basis of (e.g., corresponding to) the input image information RGBi.

The input image information RGBi, for example, may include red input information Ri, green input information Gi, and blue input information Bi having respective information on red light, green light, and blue light. Additionally, the output image data Idata may include red output data Ro, green output data Go, and blue output data Bo having respective information on red light, green light, and blue light. Additionally, the output image data Idata may include mixed output data Mo. The mixed output data Mo may include information on at least one of white light and yellow light. The mixed output data Mo is described later.

The control unit 400 includes a mapping unit 410, a color correction unit 420, and a lookup table LUT.

The mapping unit 410 receives the input image information RGBi. The mapping unit 410 may generate mapping image data Imap including information on at least four colors on the basis of (e.g., corresponding to) the input image information RGBi. In more detail, the mapping unit 410 may map the RGB gamut of the input image information RGBi into the first gamut (that is, the RGBW gamut) including white, or into the second gamut (that is, RGBY gamut) including yellow, through a Gamut Mapping Algorithm (GMA) to generate the mapping image data Imap.

The mapping image data Imap may include red mapping data Rm, green mapping data Gm, and blue mapping data Bm having respective information on red light, green light, and blue light. Additionally, the mapping image data Imap may include mixed mapping data Mm. The mixed mapping data Mm may include information on at least one of white light and yellow light. The mixed mapping data Mm is described later.

The color correction unit 420 receives the mapping image data Imap, and generates the output image data Idata on the basis of the mapping image data Imap. According to an embodiment of the inventive concept, the color correction unit 420 performs color correction on the mapping image data Imap to match a color displayed by the output image data Idata to the color of the input image information RGBi, and converts the mapping image data Imap into the output image data Idata.

According to an embodiment of the inventive concept, the color correction may be an Accurate Color Capture (ACC) correction. The color correction unit 420, for example, may perform ACC correction. The color correction unit 420 maintains color balance in each grayscale by preventing a phenomenon that color characteristics are shifted according to a change of a grayscale. The color characteristics shifted phenomenon results from gamma characteristics of the display device 1000 of FIG. 1. In more detail, because green gamma characteristics, red gamma characteristics, and blue gamma characteristics of the display device 1000 are different according to a driving method and a structure of the display device 1000, the display device 1000 may display an image having a different color from the input image information RGBi.

To compensate for such brightness difference, the color correction unit 420 may set reference gamma characteristics (for example, about 2.2 gamma), and may determine, as a gamma correction value, a deviation according to a grayscale of each of the reference gamma characteristics and the red, green, and blue gamma characteristics.

The lookup table LUT stores the gamma correction value. The color correction unit 420 reads the gamma correction value from the lookup table LUT during the ACC correction, and performs the ACC correction on the basis of the read gamma correction value.

According to an embodiment of the inventive concept, the gamma correction value may include first to fifth gamma correction values. The first to fifth gamma correction values are described later.

Figure 7:
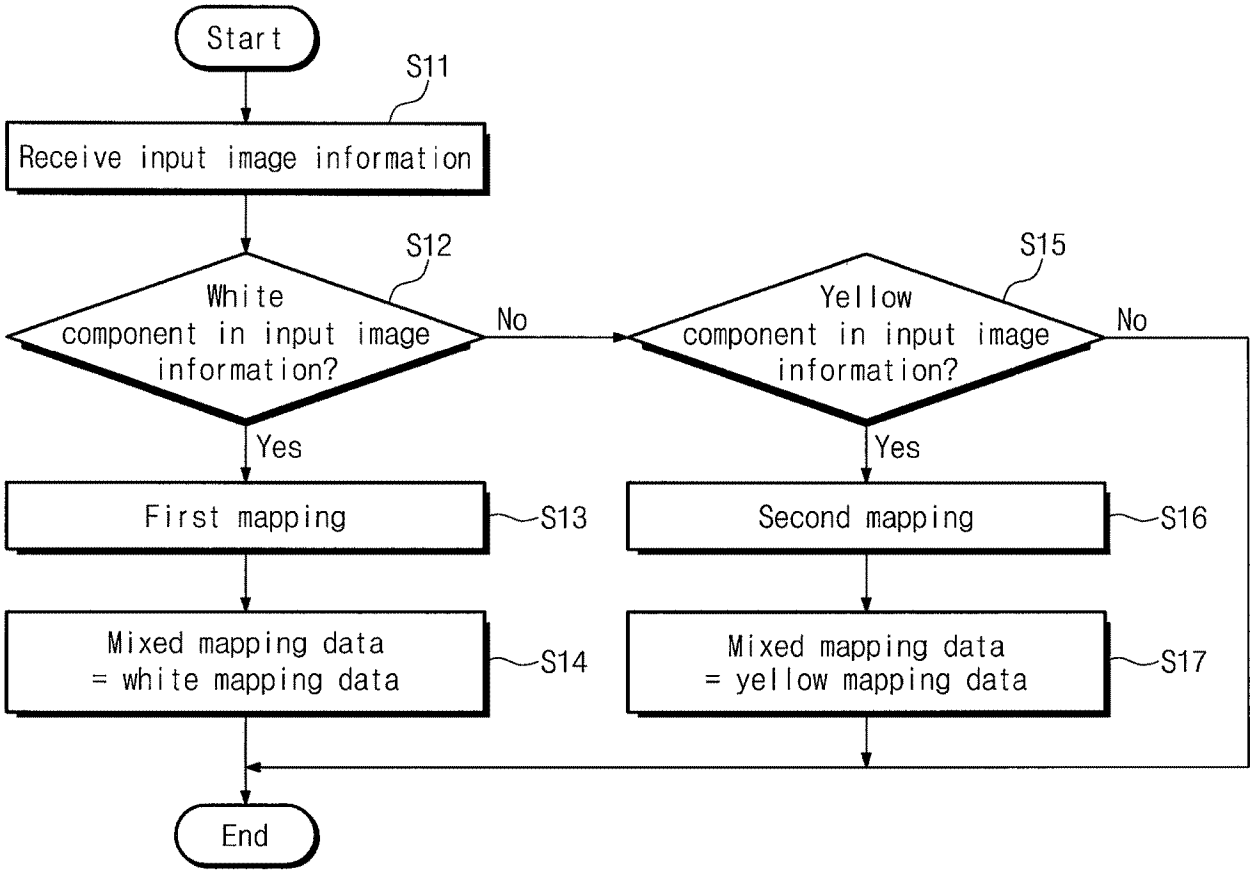
FIG. 7 is a flowchart illustrating operations of a mapping unit shown in FIG. 6.

Hereinafter, operations of the mapping unit 410 are described with reference to FIG. 7. FIG. 7 is a flowchart illustrating operations of the mapping unit 410 shown in FIG. 6.

Referring to FIGS. 6 and 7, the mapping unit 410 receives the input image information RGBi in operation S11.

Then, the mapping unit 410 determines whether there is a white component in the input image information RGBi in operation S12. If there is the white component in the input image information RGBi, the mapping unit 410 performs first mapping in operation S13.

The mapping unit 410 may generate white mapping data on the basis of the input image information RGBi through the first mapping. For example, the first mapping may include obtaining a minimum value among grayscales of the red, green, and blue input information Ri, Gi, and Bi, and may further include determining a grayscale of the white mapping data on the basis of the minimum value. In this case, grayscales of the red, green, and blue mapping data Rm, Gm, and Bm may be calculated using the grayscales of the red, green, and blue input signals Ri, Gi, and Bi and the grayscale of the white mapping data.

After the calculating of the white mapping data, the mapping unit 410 outputs the white mapping data as the mixed mapping data Mm in operation S14.

If there is no white component in the input image information RGBi, the mapping unit 410 determines whether there is a yellow component (e.g., an auxiliary color component) in the input image information RGBi in operation S15. If there is the yellow component in the input image information RGBi, the mapping unit 410 performs second mapping in operation S16.

The mapping unit 410 may generate yellow mapping data (or auxiliary color mapping data in other embodiments) on the basis of the input image information RGBi through the second mapping. For example, the second mapping may include obtaining a minimum value among the grayscales of the red and green signals Ri and Gi, and may further include determining a grayscale of the yellow mapping data on the basis of the minimum value. In this case, grayscales of the red and green mapping data Rm and Gm may be calculated using the grayscales of the red and green input signals Ri and Gi and the yellow mapping data.

After the calculating of the yellow mapping data, the mapping unit 410 outputs the yellow mapping data as the mixed mapping data Mm in operation S17.

If there are no white component and no yellow component in the input image information RGBi, the mixed mapping data Mm may include information corresponding to a 0 grayscale (i.e., a grayscale value of 0).

If putting the above contents together, the mixed mapping data Mm may further include the white mapping data or the yellow mapping data according to a white component and a yellow component, respectively, in the input image information RGBi.

Figure 8:
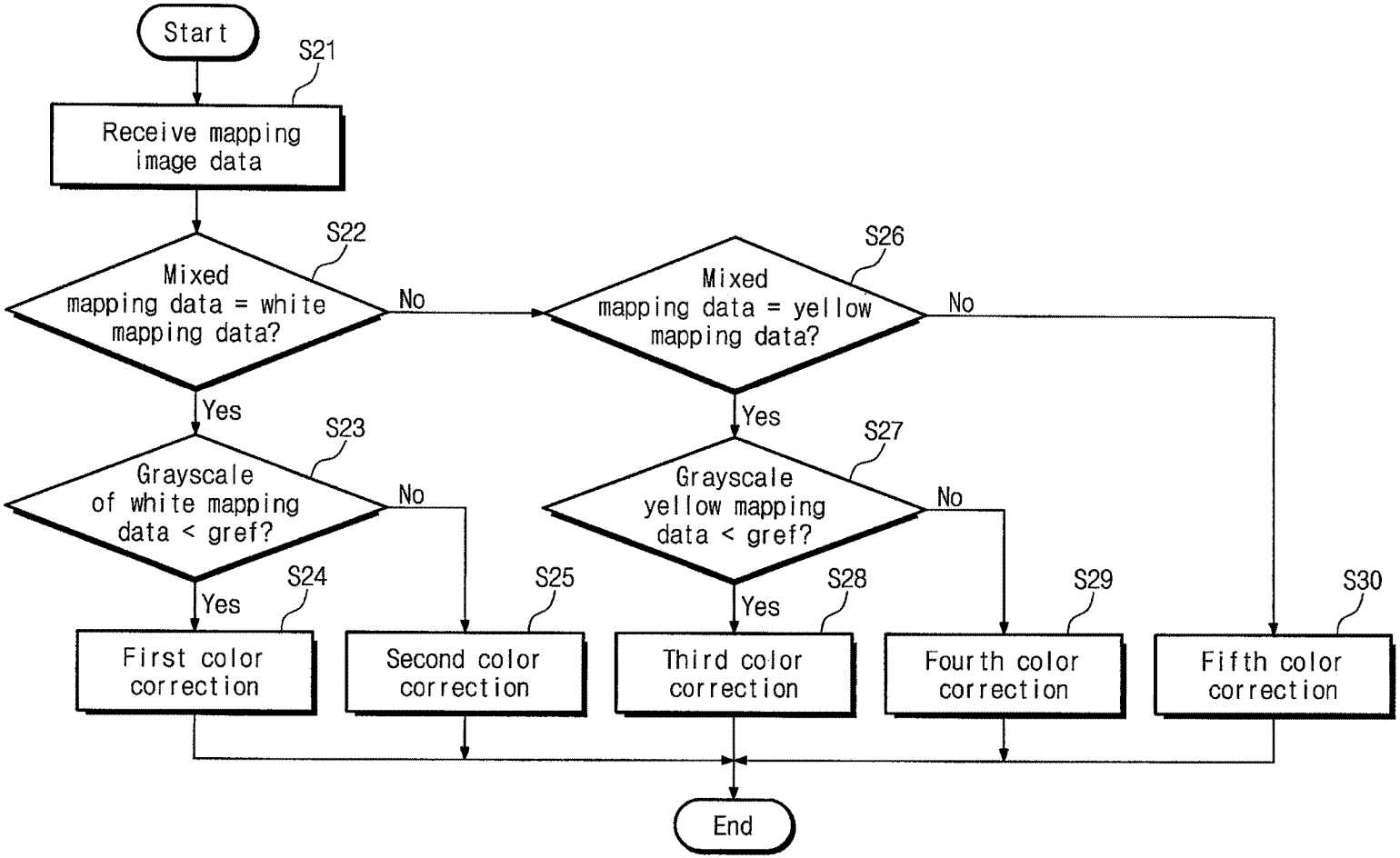
FIG. 8 is a flowchart illustrating operations of a color correction unit shown in FIG. 6.

FIG. 8 is a flowchart illustrating operations of a color correction unit shown in FIG. 6.

Referring to FIGS. 6 and 8, the color correction unit 420 receives the mapping image data Imap from the mapping unit 410 in operation S21. The color correction unit 420 determines whether the mixed mapping data Mm is white mapping data in operation S22.

When the mixed mapping data Mm is the white mapping data, the color correction unit 420 performs a first comparison to determine whether a grayscale of the white mapping data is smaller than the reference grayscale Gref in operation S23.

If the grayscale of the white mapping data is smaller than the reference grayscale Gref on the basis of the first comparison result, the color correction unit 420 performs a first color correction in operation S24. The first color correction may include converting the mixed mapping data Mm into the output image data Idata on the basis of the first gamma correction value through ACC correction. When the mixed sub pixel MPX shown in FIGS. 5A, 5B, and 5C is in the second state, the first gamma correction value is a gamma correction value determined to maintain a color balance. That is, the first gamma correction value may be determined based on yellow light displayed by the upper pixel HP shown in FIGS. 5A, 5B, and 5C, and a black image displayed by the lower pixel LP shown in FIGS. 5A, 5B, and 5C. According to the first color correction, the red, green, blue, and mixed mapping data Rm, Gm, Bm, and Mm of the mapping image data Imap may be respectively converted into the red, green, blue, and mixed output data Ro, Go, Bo, and Mo of the output image data Idata.

If the grayscale of the white mapping data is greater than the reference grayscale Gref on the basis of the first comparison result, the color correction unit 420 performs a second color correction in operation S25. The second color correction may include converting the mixed mapping data Mm into the output image data Idata on the basis of the second gamma correction value through ACC correction. When the mixed sub pixel MPX is in the third state, the second gamma correction value is a gamma correction value determined to maintain a color balance. That is, the second gamma correction value may be determined on the basis of yellow light displayed by the upper pixel HP, and on the basis of white light displayed by the lower pixel LP. According to the second color correction, the red, green, blue, and mixed mapping data Rm, Gm, Bm, and Mm of the mapping image data Imap may be respectively converted into the red, green, blue, and mixed output data Ro, Go, Bo, and Mo of the output image data Idata.

When the mixed mapping data Mm is not the white mapping data, the color correction unit 420 determines whether the mixed mapping data Mm is the yellow mapping data in operation S26.

When the mixed mapping data Mm is the white mapping data, the color correction unit 420 performs a second comparison to determine whether a grayscale of the yellow mapping data is smaller than the reference grayscale Gref in operation S27.

If the grayscale of the yellow mapping data is smaller than the reference grayscale Gref on the basis of the second comparison result, the color correction unit 420 performs a third color correction in operation S28. The third color correction may include converting the mixed mapping data Mm into the output image data Idata on the basis of the third gamma correction value through ACC correction. When the mixed sub pixel MPX is in the second state, the third gamma correction value is a gamma correction value determined to maintain the color balance. That is, the third gamma correction value may be determined on the basis of yellow light displayed by the upper pixel HP, and a black image displayed by the lower pixel LP. According to the third color correction, the red, green, blue, and mixed mapping data Rm, Gm, Bm, and Mm of the mapping image data Imap may be respectively converted into the red, green, blue, and mixed output data Ro, Go, Bo, and Mo of the output image data Idata.

If the grayscale of the yellow mapping data is greater than the reference grayscale Gref on the basis of the second comparison result, the color correction unit 420 performs a fourth color correction in operation S29. The fourth color correction may include converting the mixed mapping data Mm into the output image data Idata on the basis of the fourth gamma correction value through ACC correction. When the mixed sub pixel MPX is in the third state, the fourth gamma correction value is a gamma correction value determined to maintain a color balance. That is, the fourth gamma correction value may be determined on the basis of yellow light displayed by the upper pixel HP, and on the basis of white light displayed by the lower pixel LP. According to the fourth color correction, the red, green, blue, and mixed mapping data Rm, Gm, Bm, and Mm of the mapping image data Imap may be respectively converted into the red, green, blue, and mixed output data Ro, Go, Bo, and Mo of the output image data Idata.

According to an embodiment of the inventive concept, the fourth gamma correction value may be set to allow the grayscale of the mixed output data to not exceed the reference grayscale Gref. That is, the maximum value of a grayscale of the mixed output data Mo may be the reference grayscale Gref. If the grayscale of the mixed output data Mo exceeds the reference grayscale Gref, because the lower pixel LP is on to display white light, color blending may occur, and pure yellow light might not be displayed. Accordingly, as the grayscale of the mixed output data Mo is set not to exceed the reference grayscale Gref, the lower pixel LP may be off. As a result, a color of the input image information RGBi not including a white component may be displayed without distortion.

When the mixed mapping data Mm is not the white mapping data and is not the yellow mapping data, that is, when the mixed mapping data Mm includes information corresponding to 0 grayscale, the color correction unit 420 performs a fifth color correction in operation S30. The fifth color correction may include converting the mixed mapping data Mm into the output image data Idata on the basis of the fifth gamma correction value through ACC correction. When the mixed sub pixel MPX is in the first state, the fifth gamma correction value is a gamma correction value determined to maintain a color balance. That is, the fifth gamma correction value may be determined on the basis of a black image displayed by the upper pixel HP and on the basis of a black image displayed by the lower pixel LP.

If putting the above contents together, because the output image data Idata is processed in consideration of the first, second, and third states of the mixed sub pixel MPX, the mixed sub pixel MPX may be driven in one of the first, second, or third states to correspond to the color of the input image information RGBi. As a result, the brightness and color reproducibility of the display panel shown in FIG. 1 may be improved.

Figure 9:
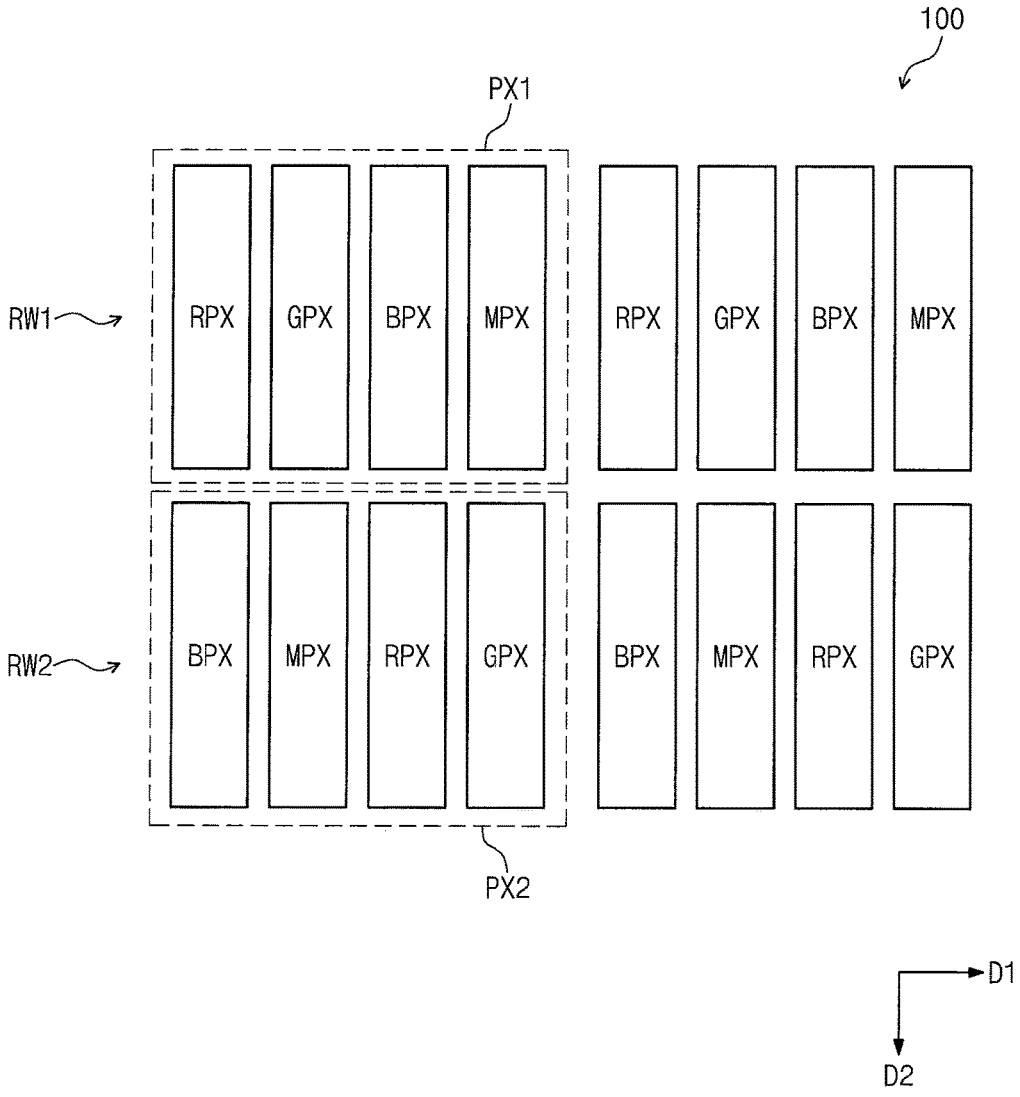
FIG. 9 is an enlarged plan view illustrating a part of a display panel according to an embodiment of the inventive concept.

FIG. 9 is an enlarged plan view illustrating a part of a display panel according to an embodiment of the inventive concept.

Referring to FIG. 9, the display panel 100 includes a first pixel PX1 and a second pixel PX2.

The first pixel PX1 may include red, green, blue, and mixed sub pixels RPX, GPX, BPX, and MPX arranged along the first direction D1 in the order of the red sub pixel RPX/the green sub pixel GPX/the blue sub pixel BPX/the mixed sub pixel MPX.

The second pixel PX2 may include red, green, blue, and mixed sub pixels RPX, GPX, BPX, and MPX arranged along the first direction D1 in the order of the blue sub pixel BPX/the mixed sub pixel MPX/the red sub pixel RPX/the green sub pixel GPX.

The first pixel PX1 is at a first row RW1 repeatedly, and the second pixel PX2 is at a second row RW2 repeatedly. Accordingly, the first and second pixels PX1 and PX2 may be alternately disposed along the second direction D2.

According to the inventive concept, because a mixed sub pixel includes a lower pixel for displaying white color, and includes an upper pixel for displaying an auxiliary color, the color reproducibility and brightness of a display device may be improved. Additionally, because the low and upper pixels are connected to the same data line, an additional data line for driving the low and upper pixels may not be required, and the number of data lines in a display device may be reduced. Accordingly, the aperture ratio and resolution of a display device may be improved, and its power consumption may be reduced.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A display device comprising a pixel comprising:
a mixed sub pixel configured to receive a mixed data voltage;
a red sub pixel comprising a red lower pixel and a red upper pixel;
a blue sub pixel comprising a blue lower pixel and a blue upper pixel; and
a green sub pixel comprising a green lower pixel and a green upper pixel,
wherein, the mixed sub pixel comprises:
a lower pixel configured to display white light having a white color corresponding to the mixed data voltage; and
an upper pixel configured to display an auxiliary color light having an auxiliary color corresponding to the mixed data voltage, and
wherein the lower pixel and the upper pixel are non-overlapping in a plane view.

2. The display device of claim 1, wherein an intensity of the white light is less than an intensity of the auxiliary color light according to a mixed grayscale of the mixed data voltage.

3. The display device of claim 2, wherein the lower pixel corresponds to a first gamma curve with respect to the mixed grayscale of the mixed data voltage,
wherein the upper pixel corresponds to a second gamma curve with respect to the mixed grayscale of the mixed data voltage, and
wherein the second gamma curve corresponds to a greater intensity than the first gamma curve.

4. The display device of claim 3, wherein a gamma value of the first gamma curve is greater than about 2.2, and
wherein a gamma value of the second gamma curve is less than about 2.2.

5. The display device of claim 2, wherein the lower pixel is turned off in a low grayscale section, and is turned on in a high grayscale section, and
wherein the mixed grayscale of the mixed data voltage is less than a reference grayscale in the low grayscale section, and is greater than the reference grayscale in the high grayscale section.

6. The display device of claim 5, wherein the upper pixel is turned on in the low grayscale section.

7. The display device of claim 6, wherein an intensity of the white light is less than an off perception intensity in the low grayscale section, which is not perceivably different from an off intensity corresponding to a grayscale value of 0.

8. The display device of claim 5, further comprising:
a control unit configured to generate mixed output data corresponding to input image information; and
a mapping unit configured to:
perform a first mapping on the input image information with a first gamut comprising white when there is a white component in the input image information; and
perform a second mapping on the input image information with a second gamut comprising the auxiliary color when there is an auxiliary color component in the input image information and there is no white component in the input image information; and
a data driver configured to convert the mixed output data into the mixed data voltage.

9. The display device of claim 8, wherein the mapping unit is further configured to:
generate white mapping data corresponding to the white component corresponding to the input image information through the first mapping;
output the white mapping data as mixed mapping data;
generate auxiliary color mapping data corresponding to the auxiliary color component corresponding to the input image information through the second mapping; and
output the auxiliary color mapping data as the mixed mapping data.

10. The display device of claim 9, wherein the control unit comprises a color correction unit that, when the mapping unit performs the first mapping, is configured to:
perform a first comparison of the reference grayscale to a grayscale value of the white mapping data;
correct the white mapping data with a first gamma correction value or a second gamma correction value according to the first comparison; and
output a first correction result as the mixed output data.

11. The display device of claim 10, wherein the mapping unit is further configured to generate red mapping data, green mapping data, and blue mapping data corresponding to the input image information, and
wherein the color correction unit is further configured to correct the red mapping data, the green mapping data, and the blue mapping data with the first or second gamma correction value according to the first comparison when the mapping unit performs the first mapping.

12. The display device of claim 10, wherein, when the mapping unit performs the second mapping, the color correction unit is further configured to:
perform a second comparison on the reference grayscale and a grayscale value of the auxiliary color mapping data;
correct the auxiliary color mapping data with a third gamma correction value or a fourth gamma correction value according to the second comparison; and
output a second correction result as the mixed output data.

13. The display device of claim 12, wherein the mapping unit is further configured to generate red mapping data, green mapping data, and blue mapping data corresponding to the input image information, and
wherein the color correction unit is further configured to correct the red mapping data, the green mapping data, and the blue mapping data with the third or fourth gamma correction value according to the second comparison when the mapping unit performs the second mapping.

14. The display device of claim 13, wherein a maximum value of a grayscale of the mixed output data comprises the reference grayscale.

15. The display device of claim 1, further comprising a data line configured to output the mixed data voltage,
wherein the upper pixel comprises an upper pixel circuit configured to provide the mixed data voltage to an upper pixel electrode of the upper pixel, and
wherein the lower pixel comprises a lower pixel circuit configured to:
lower a level of the mixed data voltage to covert the mixed data voltage into a low data voltage; and
provide the low data voltage to a lower pixel electrode of the lower pixel.

16. The display device of claim 15, wherein the upper pixel circuit comprises an upper transistor comprising:
a source electrode coupled to the data line;

a gate electrode coupled to a gate line of the display device; and a drain electrode coupled to the upper pixel electrode.

17. The display device of claim 15, wherein the lower pixel circuit comprises a first lower transistor comprising:

a source electrode connected to the data line;

a gate electrode connected to a gate line of the display device; and a drain electrode connected to the lower pixel electrode; and a second lower transistor comprising:

a source electrode configured to receive a lowered voltage;

a gate electrode connected to the gate line; and a drain electrode connected to the lower pixel electrode.

18. The display device of claim 1, wherein the auxiliary color is a secondary primary color.

19. A display panel comprising:

a mixed data line;

a red sub pixel comprising a red lower pixel and a red upper pixel;

a blue sub pixel comprising a blue lower pixel and a blue upper pixel;

a green sub pixel comprising a green lower pixel and a green upper pixel; and a mixed sub pixel comprising:

an upper pixel connected to the mixed data line and comprising a first color filter configured to transmit an auxiliary color; and a lower pixel connected the mixed data line and not including a color filter.

* * * * *